US005512877A

United States Patent [19]

Gels et al.

[11] Patent Number: 5,512,877

[45] Date of Patent: Apr. 30, 1996

[54] CURRENCY REMOVAL SENSOR SYSTEM

[75] Inventors: James R. Gels, Fairfield; Robert D. Smith, Cincinnati; Steven A. Snyder, Loveland, all of Ohio

[73] Assignee: Mosler, Inc., Hamilton, Ohio

[21] Appl. No.: 437,513

[22] Filed: May 9, 1905

Related U.S. Application Data

[63] Continuation of Ser. No. 216,673, Mar. 23, 1994, abandoned.

[51] Int. Cl.[6] ..... G08B 13/02

[52] U.S. Cl. ..... 340/570; 200/61.61; 109/39

[58] Field of Search ..... 340/570, 568; 200/61.61, 61.19; 116/76; 109/39

[56] References Cited

U.S. PATENT DOCUMENTS

| | | | |
|---|---|---|---|
| 1,406,447 | 2/1922 | Dillion et al. | 200/85 R |
| 1,494,656 | 5/1924 | Wherland | 340/521 |
| 1,534,363 | 4/1925 | Day | 200/61.19 |
| 1,903,535 | 4/1933 | Scott | 200/61.19 |
| 2,264,952 | 12/1941 | Rankin | 200/52 |
| 2,416,963 | 3/1947 | Stelter | 177/314 |
| 3,036,298 | 5/1962 | Schiller | 340/570 |
| 3,187,129 | 6/1965 | McBrian | 200/61.62 |
| 3,247,502 | 4/1966 | Eberts | 340/539 |
| 3,253,271 | 5/1966 | Trupiano et al. | 340/570 |
| 3,300,770 | 1/1967 | Brousseau et al. | 340/570 |
| 3,303,592 | 2/1967 | Harner | 42/1 |
| 3,383,673 | 5/1968 | Garling | 340/570 |
| 3,432,842 | 3/1969 | Poznanski | 340/570 |
| 3,467,771 | 9/1969 | Polack | 178/6.6 |
| 3,569,644 | 3/1971 | Brugger et al. | 200/61.61 |
| 3,618,060 | 11/1971 | Nina | 340/224 |
| 3,636,547 | 1/1972 | Brace et al. | 340/570 |
| 3,725,893 | 4/1973 | Malta et al. | 340/570 |
| 3,836,007 | 9/1974 | Rosenwein | 211/13 |
| 3,913,087 | 10/1975 | McBrian | 340/568 |
| 4,268,823 | 5/1981 | Rauchut et al. | 340/570 |
| 5,059,949 | 10/1991 | Caparoni et al. | 340/571 |

*Primary Examiner*—John K. Peng
*Assistant Examiner*—Albert K. Wong
*Attorney, Agent, or Firm*—Wood, Herron & Evans

[57] ABSTRACT

A currency removal sensor system for detecting removal of currency from a cash drawer includes a tray base positioned within the bottom of the cash drawer and a removable tray sitting on top of the base. A sensor is mounted at a predetermined location in the tray base and is coupled to alarm circuitry. The tray includes a number of currency compartments, at least one of the currency compartments including a pivoting currency clip having an upward position and a downward position. The currency clip includes a magnet which is suspended away from the sensor in the base when the clip is in the upward position and which lies proximate the sensor when the clip is in the downward position to activate the sensor and initiate an alarm. A stack of currency is placed beneath the clip arm to suspend the arm and prevent an alarm when the tray is on the tray base in the cash drawer whereby the currency tray, which is not electrically or physically connected to the tray base, may be quickly and easily removed from the base and cash drawer without initiating an alarm; however, removing the currency from the compartment when the tray is in the drawer allows the clip device to fall to the downward position and initiate an alarm.

11 Claims, 3 Drawing Sheets

CURRENCY REMOVAL SENSOR SYSTEM

RELATED APPLICATION

This application is a continuation of application Ser. No. 08/216,673, filed Mar. 23, 1994, entitled CURRENCY REMOVAL SENSOR SYSTEM, now abandoned.

FIELD OF THE INVENTION

This invention relates generally to alarm sensor systems which detect the unauthorized removal of currency from a cash drawer, and specifically to clip-type sensor systems which utilize a sensor clip to hold a currency stack and initiate an alarm signal upon removal of the stack from the sensor clip.

BACKGROUND OF THE INVENTION

In environments where paper currency is used and stored, it is desirable to have an alarm system in place. Generally, such an alarm system, upon being triggered, provides a remote alarm signal, activates a camera or audible alert sound, or initiates other similar steps to indicate that the currency has been unlawfully taken. For example, cash drawer structures full of currency are often used, such as in banks or retail establishments, wherein a teller or cashier exchanges currency back and forth between customers and the cash drawer during transactions. Additionally, currency may be stored in such cash drawers between business hours. Accordingly, it is desirable to have an alarm system which initiates an alarm sequence when currency is unlawfully removed from the cash drawer by a thief, cashier or teller under the control of a thief, such as at gunpoint in an armed robbery.

Alarms for cash drawers are often silent alarms which initiate an alarm sequence in a remote location to alert the proper authorities without alerting the thief. Silent alarms are desirable because they fool the thief into believing that he has not been detected. Furthermore, silent alarms do not scare the thief and aggravate what may be an already dangerous situation, for example, when the robbery is taking place at gunpoint. Silent alarms, are usually triggered in an unobtrusive manner to prevent the thief from knowing that an alarm has been initiated even if he cannot see or hear the alarm.

One popular unobtrusive and silent alarming system utilized in cash drawers is the money clip-style alarm system. Clip-style alarm systems use a money clip device located within a currency compartment in the cash drawer. The money clip physically grasps or contacts a currency bill or a stack of bills within the drawer. The bill stack suspends or holds a section of the clip away from a triggering device. When the stack is removed from the clip, the suspended clip section falls or otherwise moves to contact the triggering device and initiate an alarm. While such clips have the advantages of simple operation and unobtrusiveness in the drawer, therefore often going unnoticed, clip-style alarm devices generally require extensive installation procedures thus making them inconvenient to assemble, complicated to install, expensive, and subject to false alarms.

Installation of many prior art clip-style alarms requires extensive retrofitting of an existing cash drawer structure. Generally, a large number of holes must be drilled within the cash drawer and supporting structure to mount and install the clip-style device and the various supporting wires, plugs and connectors. Alternatively, the cash drawer structure may have to be specially manufactured with a clip-style alarm system assembled therein. The system must then be hard-wired to connecting wires in a wall or floor to connect the system to the remote alarm circuitry. The dedicated hard wiring between the cash drawer and the external alarm circuitry makes the system generally immobile. Furthermore, the various wires, plugs and connections extending between the clip device and the cash drawer makes efficient removal of all of the currency from the cash drawer difficult.

For example, it is often desirable to remove the currency from the cash drawer at the end of the business day and place it in a vault or some other safe structure for the evening. The currency is then returned to the cash drawer by the teller at the start of the next business day. With various currency denominations in a single cash drawer, it is impractical and inefficient to remove each currency stack individually. Therefore, tray inserts full of currency of different denominations are often used so that a teller may remove all of the currency at once by removing the tray. However, since the trays have to be fitted with the clip device when using a clip-style alarm system, the tray will need to be connected by wires and other connectors to the cash drawer and the alarm system. Consequently, either the trays cannot be readily removed, or, upon removal of a tray from a cash drawer, various steps need to be taken to disconnect the wires, plugs and other connections between the tray and the cash drawer.

Extensive disconnection and reconnection of the tray and money clip to the alarm system in the cash drawer makes use of such alarms inconvenient for the tellers and adds to the amount of time that it takes to close up at the end of the business day and open up at the start of the next business day. Additionally, the clip devices and the system wiring are exposed to constant movement during disconnection and reconnection which results in part breakage, connector damage and loose wiring which may disarm the alarm system. Consequently, prior art money clip alarm systems need constant maintenance and part replacement, thereby increasing the cost of such systems.

Furthermore, with prior art clip-style systems, steps must be taken during disconnection and reconnection of the tray to the cash drawer to prevent a false alarm from sounding. As may be appreciated, the extensive efforts required on behalf of the teller to remove and return a tray to a cash drawer often causes the money clip to be inadvertently moved and the alarm activated. Also, the time spent disconnecting and removing the tray after the clip has been disconnected from the alarm system leaves a window of time in which a thief might steal the currency from the tray without sounding an alarm.

The extensive retrofitting, installation and repairs required to utilize prior art money clip-style alarm systems drives up the overall expense of the system. Therefore, while the operation of a clip-style alarm system is relatively simple and reliable, the difficulties encountered in installing and using the prior art clip-style systems makes the cost of such systems relatively high.

Accordingly, it is desirable to have a money removal sensor system, and preferably a system utilizing a money clip-style device, which may be readily installed in a cash drawer with minimal retrofitting, costs and complexity. Furthermore, it is desirable to have a clip-style alarm system which allows rapid and easy removal of a tray full of currency from the cash drawer without disconnecting numerous wires and other connections between the tray and the drawer. Another objective is an alarm system which requires few or no complex steps to disengage the alarm initiating circuitry prior to removing the tray, thereby decreasing the amount of false alarms associated with removing and returning the tray to the cash drawer. Further, it is an objective to have a system in which the currency tray is transferred to and from the cash drawer rapidly, thus closing the window of opportunity that a thief may have to steal money after the alarm system has been disconnected. These and other objectives are accomplished by the present invention as described hereinbelow.

SUMMARY OF THE INVENTION

The currency removal sensor system of the present device utilizes a clip-style device to activate an alarm, but the system of the present invention eliminates the various complexities normally associated with such clip-style systems. Specifically, the sensor system of the present invention utilizes a tray base configured to fit into the bottom of an existing cash drawer and a currency tray which sits on top of the base and has a number of compartments to hold currency. A magnetic field sensor is positioned in the tray base at a predetermined location, while a magnetic element is located on a clip structure located in a currency compartment above the sensor. When currency is removed from under the clip structure, a clip arm pivots downwardly, and the sensor detects the magnetic field of the magnetic element on the clip and initiates an alarm. No direct physical contact is made between the sensor and the clip and there are no direct electrical connections between the tray and the tray base. The sensor is electrically connected to a telephone block connector on the tray base which is coupled to a telephone jack in the cash drawer structure which connects to alarm circuitry.

More specifically, the currency tray sits on the tray base and there are no wire connections between the base and the tray, so that the tray is easily removable from the cash drawer. The tray preferably includes an insert which defines a plurality of currency compartments. At least one of the currency compartments inside the tray includes the currency clip structure with the pivoting clip arm to clasp a stack of currency. The clip arm pivots between an upward position and a downward position with the magnetic element at its outward end. The tray is situated on the tray base such that the currency compartment containing the clip structure overlies the magnetic field sensor. When the clip arm grasps a currency stack, the magnetic element is held in the upward position, the field sensor does not detect a magnetic field, and no alarm is initiated. However, if the currency stack is removed, the arm and magnetic element pivots into the downward position to rest proximate the person and the field associated with the magnetic element is detected by the magnetic field sensor and an alarm is initiated.

The field sensor preferably includes a magnetic switch, such as a reed relay switch, which is normally closed but which opens upon detection of a magnetic field. The normally closed relay switch presents continuity in the system that, if broken, will initiate an alarm. Therefore, if a thief tries to disarm the system by cutting the wires, an alarm will sound. The currency stack holding the clip arm up may consist of all currency or may be an insert covered by at least a single bill to give the indication that it is a currency stack. When the bill is removed from the top of the insert, the clip arm swings down and initiates an alarm.

The tray and base are not directly electrically connected, and therefore, the currency tray may be simply removed and returned to the cash drawer without initiating an alarm as long as the clip is maintained in the upward position. Therefore, a teller may remove and replace the currency tray rapidly and easily at the end and beginning of the business day, respectively.

Since there are no wires to disconnect and reconnect when using the system, there is little possibility of false alarms. Furthermore, since the tray may be rapidly removed from the cash drawer, there is very little alarm down time between removing the tray and placing it in the vault during which a thief may steal the currency from the tray undetected. The sensor system of the present invention is inexpensively installed and does not require a large amount of additional wires, plugs or electrical connections between the tray and cash drawer to operate properly. A telephone line extends from a drawer structure telephone jack to the telephone block connector on the tray base. The telephone jack on the cash drawer structure is connected to remote alarm circuitry and the telephone line couples the tray to the remote alarm circuitry. If it is desirable to remove the drawer from the drawer structure with the tray intact, the phone line is simply unplugged from the base block connector, and the drawer can be removed.

Both the field sensor and the clip structure are selectively movable to arm any one of the plurality of currency compartments in the currency tray. Alternatively, each currency compartment may utilize a clip with an associated sensor to arm the entire tray. Cushion pads are inserted above and below the pivoting clip arm so that when pivoting between the upward and downward positions, the arm does not strike a section of the currency compartment or currency tray and cause a noise. Therefore, activation of an alarm by the present system is generally silent with no associated clicking sound or other sound.

Other distinct features and advantages of the present invention will become more readily apparent from the drawings and detailed description of the invention given below.

BRIEF DESCRIPTION OF THE DRAWINGS

FIG. 1A is a side view, in section, of the money removal sensor system of the present invention in the currency compartment; while

DETAILED DESCRIPTION OF THE INVENTION

Figure 1A:
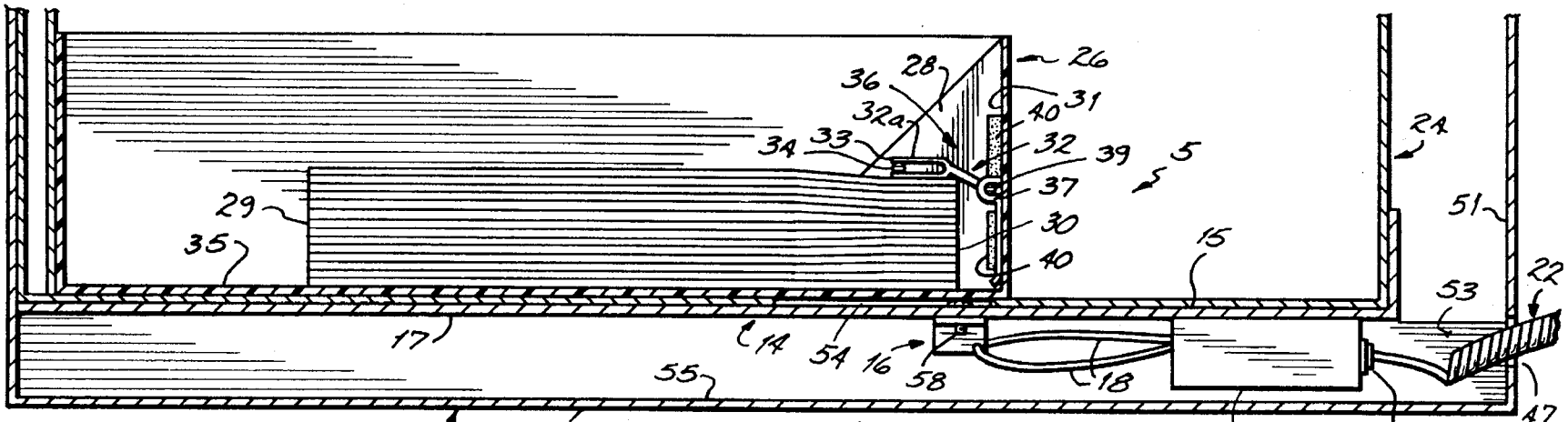
Figure 1B:
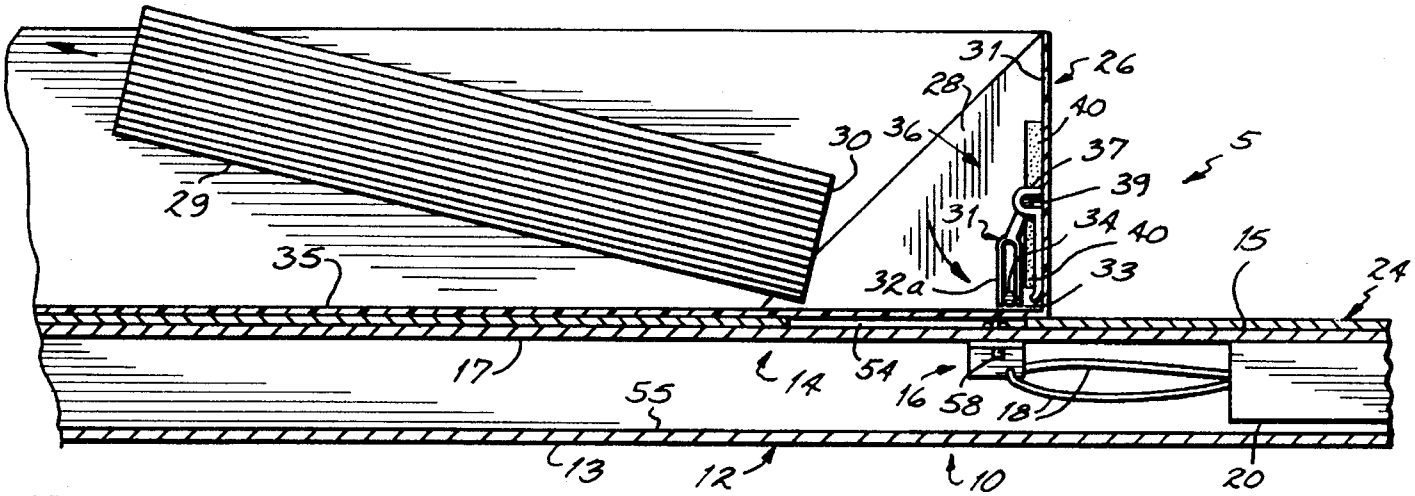
FIG. 1B is a side view similar to FIG. 1A showing the currency removed and the clip structure pivoted downwardly to initiate an alarm.

The money removal sensor system of the present invention installs within an existing cash drawer structure, such as, for example, a pedestal unit having a plurality of vertically stacked cash drawers. The money removal sensor system is illustrated in FIGS. 1A and 1B in the currency safe/alarm unactivated state and the currency removed/alarm activated state, respectively. Specifically, FIG. 1A shows a side view of the system 5 inside of a cash drawer structure 10. The cash drawer structure 10 includes at least one cash drawer 12. In the bottom of the cash drawer 12, a currency tray base 14 is mounted generally parallel and coextensive with the bottom surface 13 of the drawer 12. At a selected location on base 14, on bottom side 17 of the base 14, a field sensor 16 is mounted. The field sensor 16 preferably detects magnetic fields and is connected by connecting wires 18 to a telephone block connector 20. Upon detecting a magnetic field, sensor 16 initiates an alarm as further described hereinbelow.

Telephone block connector 20 is an adaptor to electrically couple sensor lines 18 and sensor 16 to a standard telephone line 22. The telephone line 22 is connected to a wall telephone jack 23 that is installed in the back of the drawer structure 10. Telephone jack 23 is connected to external monitoring and alarm equipment 25 via line 27 such as an audible alarm, camera, guard station, etc. (See FIG. 3). Therefore, the money removal sensor system 5 of the present invention is coupled to the alarm circuitry 25 with a standard telephone line such as a springy telephone cord. The drawer 12 may be removed with a tray 24 intact by simply unplugging the phone line plug 22*a* of line 22 from block connector 20 and pulling the drawer 12 out of structure 10. Furthermore, constant movement of the drawer 12 may wear cord 22 to the point where it needs to be replaced. In the present invention, the system user thereby unplugs line 22 from connector 20 and jack 23 and substitutes a new phone line or cord 27 which are readily available. No special wires or connecting cables are necessary.

Currency tray 24 sits on top of base 14 within cash drawer 12. Within currency tray 24 there is preferably an insert 26 which defines individual currency compartments 28 (See FIGS. 2 and 3). Alternatively, the currency tray 24 might have various walls, instead of an insert, to define a plurality of currency compartments 28. Within currency compartment 28, a stack of currency bills 29 is situated preferably with the rear end 30 of stack 29 proximate the rear wall 31 of compartment 28. A clip structure 36 is mounted on the rear wall 31 of compartment 28, and comprises a pivotable clip arm 32 which pivots between an upward position and a downward position.

When the currency stack 29 is situated as shown in FIG. 1A, it lies beneath clip arm 32 and props the arm 32 in the upward position. Located at the outward end 33 of arm 32, away from the rear wall 31, is a magnetic element 34, preferably a permanent magnet. Magnet 34 generates a magnetic field, while sensor 16 is designed to sense a magnetic field. When clip arm 32 is held in the upward position by currency stack 29, the magnetic field created by magnet 34 in the region of sensor 16 is too small to have an affect on the sensor. Consequently, no alarm is initiated and the system is in the "currency safe" condition. However, upon removal of stack 29, the system 5 initiates an alarm.

Referring to FIG. 1B, upon removal of currency stack 29, arm 32 pivots under the force of gravity to its downward position. In the downward position, arm 32 lies generally parallel with the rear wall 31. Magnet 34 at the end of arm 32 then lies juxtaposed with the floor 35 of compartment 28. Sensor 16 is mounted on base 14 in a location such that when arm 32 is in the downward position, magnet 34 overlies the sensor 16 as shown in FIG. 1B. With clip arm 32 in the downward position, the magnetic field generated by magnet 34 is strong enough to be detected by sensor 16 due to the proximity of magnet 34 and sensor 16.

In a preferred embodiment, sensor 16 is a reed relay switch which is in the normally closed configuration and which opens in the presence of a sufficiently strong magnetic field. In the invention, the reed relay switch 16 opens due to the field of magnet 34 when arm 32 is in the downward position. Switch 16 operates by maintaining continuity (i.e., 0 Ohms) across wires 18 in the normal, non-alarm state. The external monitoring equipment 25, through phone line 22, monitors for continuity. When the currency stack 29 is unlawfully removed from cash tray 24, arm 32 falls and the switch 16 opens and breaks continuity. The monitoring equipment 25, upon detecting the break in continuity, initiates an alarm sequence to alert the appropriate authorities. Since the system maintains continuity in the normal, non-alarm state, the system will also initiate an alarm when any of the system wires, such as wires 18 or line 22, are cut. Therefore, any attempt to disconnect the system by cutting the connecting wires will result in an alarm.

Figure 2A:
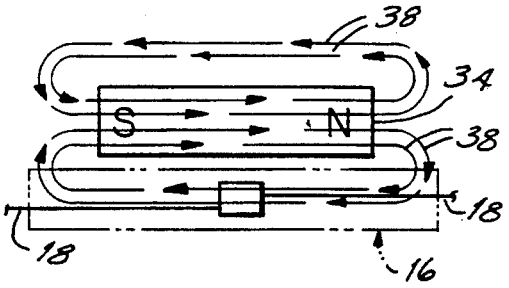
FIG. 2A is a diagramatic front view of magnet and sensor shown in proximity to one another as in the alarm mode.
Figure 2:
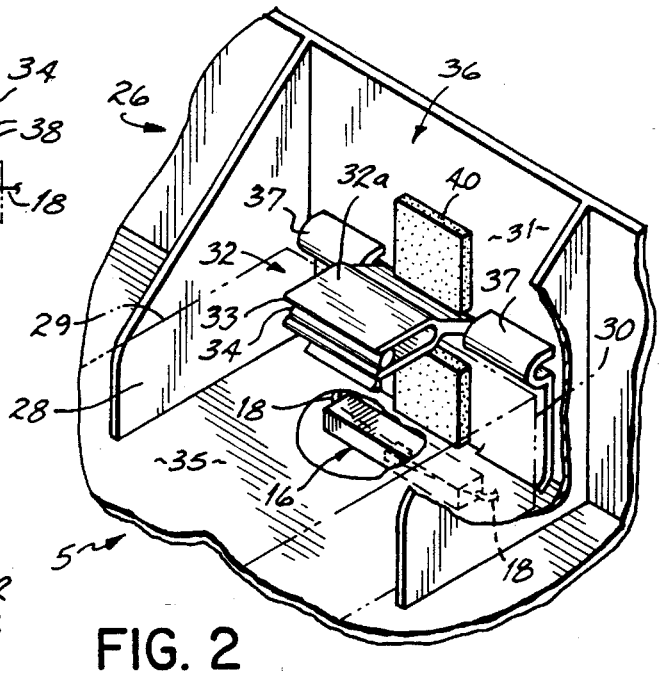
FIG. 2 shows a perspective view of a currency compartment and alarm circuitry for the money removal sensor system of the present invention.

Referring now to FIG. 2, the clip structure 36 is shown fixed to the rear wall 31 of a currency compartment 28. The clip arm 32 is pivotally connected to clip structure 36 by opposing side extensions 39 (not shown in FIG. 2) rotatably held within channel sections 37. Clip arm 32 includes a generally U-shaped gripping section 32*a* which grips and holds magnet 34 at the end of arm 32. As shown in FIG. 2A, magnet 34 is preferably elongated and cylindrical in the general shape of a cylindrical bar. The length of bar magnet 34 extends in a direction parallel with the longitudinal direction of reed relay switch 16 located beneath bottom wall 35 of currency compartment 28 on the currency tray base 14. Magnet 34 preferably has opposite magnetic polarities at its opposite ends so that the magnetic field lines 38 of bar magnet 34 extend parallel reed relay switch 16. The field lines 38 concentrate the magnetic field along the length of the switch 16 to more efficiently open the switch and initiate an alarm when the clip arm 32 pivots downwardly.

While the embodiment of the invention disclosed herein utilizes a pivoting magnet and a reed relay switch which is activated to open upon sensing a magnetic field, similarly operating non-contact devices might also be utilized. For example, an element which generates an electric field might be located in place of magnet 34 while reed relay switch 16 would be activated upon detection of an electric field when arm 32 pivots into the downward position. Alternatively, an infrared source might be located on arm 32 while an infrared detector would be mounted in place of sensor 16. The magnet and reed relay switch operate without wires; therefore, there are no physical or electrical connections, between tray 24 and base 14. Tray 24 may be removed from base 14 and drawer 12 without disconnecting or unplugging any electrical connections.

Referring again to FIG. 2, cushion pads 40 are preferably fixed to the rear wall 31 of compartment 28 and located above and below the pivotable clip arm 32. Pads 40 cushion the arm 32 when it pivots to keep the arm from striking wall 31 to ensure quiet operation of the clip structure. Clip arm 32 thereby pivots freely but does not rattle within the currency tray 24, and the silent operation of the arm prevents a thief from becoming aware that an alarm has been activated. Silence may be critical where the thief has a gun and has directed the teller or other personnel to remove all the currency from the drawer without activating the alarm. A distinctive click or rattle may frighten the thief causing a tense situation to escalate into shooting and possible injury to the teller.

Therefore, money removal sensor system 5 initiates an alarm sequence upon the unauthorized removal of a stack of currency from cash drawer 12. Since the system operates only upon removal of the currency, it is activated both when the currency is removed unknowingly by a thief and when it is removed by a cash teller under the direction of the thief.

As illustrated in FIGS. 1A and 1B, there are no electrical wires connecting the pivotable clip arm 32 or clip structure 36 in the insert 26 with switch 16 in the tray base 14. Therefore, the currency tray 24 may be simply lifted off of base 14 and out of the cash drawer structure 10 without disconnecting any wires, plugs or other alarm circuitry. This promotes a quick and efficient removal of the tray 24 from drawer 12 whereupon it may be quickly moved to a vault or some other locked enclosure. At the start of the next business day, the tray 24 is then moved from the vault back into the drawer structure and the clip arm 32 and sensor switch 16 are immediately coupled into the alarm system. Alternatively, simply leaving the tray 14 in the drawer structure 10 keeps the money removal sensor system activated. As long as a stack of currency is within the alarmed currency compartment to support arm 32, tray 24 will not initiate an alarm when removed and placed back into the drawer 12. Furthermore, reducing the time spent disconnecting or removing the tray from the drawer reduces the window of opportunity in which a thief might strike to steal currency when the alarm system has been deactivated.

Figure 3:
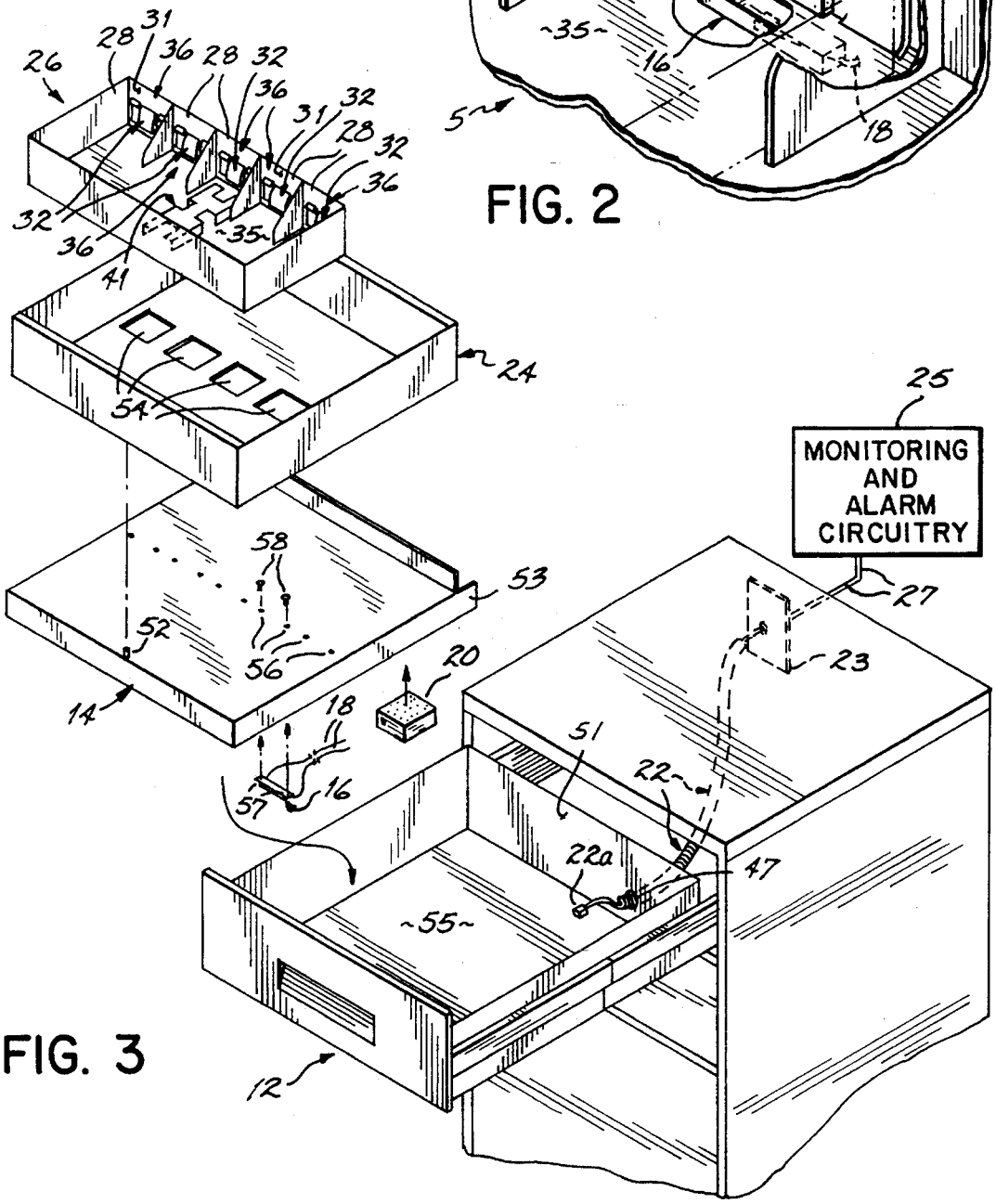
FIG. 3 is a disassembled perspective view of the money removal sensor system of the present invention installed in a cash drawer.
Figure 4:
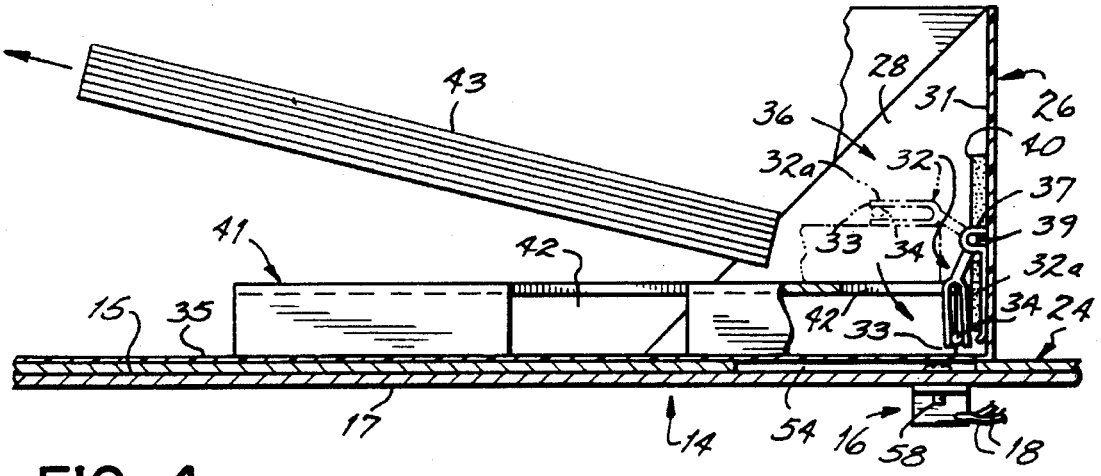
FIG. 4 is a side view similar to FIG. 1B but with a currency standoff in use.

While a stack of currency 29 might be utilized to support pivotable clip arm 32 in the upward position, it may also be desirable to utilize only a small amount of currency such that when the stack is grabbed, the thief does not receive a large amount of money. To this end, a currency standoff 41 might be utilized to elevate the height of a small currency stack 43 to prop up clip arm 32. As illustrated in FIGS. 3 and 4, standoff 41 has slots 42 through which arm 32 and magnet 34 may fall. Referring to FIG. 4, when a few currency bills are placed on top of standoff 41 and over the slot 42 they support arm 32 and give the appearance that an entire stack of currency bills lies beneath clip arm 32. Then, when the thief removes the small amount of currency 43 from the top of standoff 41, the arm drops through slot 42 and initiates an alarm. In that way, a large stack of currency bills does not have to be under arm 32 to support it, nor removed to activate the sensor and subsequently initiate an alarm. When the arm is in the upward position supported by the standoff 41 and currency 43, other currency bills (not shown) might be placed over the arm to hide it.

Referring to FIG. 3, an exploded view of the money removal sensor system 5 as installed within a money drawer structure 10 is shown. The first step of installation of the money removal sensor system 5 into a cash drawer 12, is to remove the cash drawer 12 from the associated drawer pedestal structure 10. Adjacent the space previously occupied by cash drawer 12, a wall-mount telephone jack 23 is installed in the back of structure 10 located preferably in the upper rear of the rear wall of the pedestal structure 10. Telephone jack 23 is then connected to external alarm and monitoring circuitry 25 by lines 27. The lines 27 may already be in place, such as when the drawer pedestal structure 10 is pre-installed, or may need to be connected pursuant to installing the system of the present invention. Next, the telephone or cord line 22 is connected to jack 23. A hole 47 is drilled preferably on the right side of the rear wall 51 of drawer 12 so that the line 22 may extend through drawer 12 and connect the system 5 to the external monitoring and alarm equipment 25.

Next, it is necessary to determine the preferred orientation of the cash tray 24 within the drawer 12 as well as choose the preferred currency compartment to hold the clip structure 36 and "bait" currency. With the cash tray 24 orientation determined, the tray base 14 is mounted to the bottom 55 of drawer 12. A locator pin 52 on tray base 14 fits within a recess (not shown) on tray 24 and will only allow tray 24 to be installed in one direction once base 14 has been installed. In FIG. 3, the currency tray base 14 and currency tray 24 are shown oriented to extend to the front of drawer 12. Tray base 14 includes tabs 53 on either side for spacing purposes. If the cash tray 24 is to be oriented at 90° from the position shown in FIG. 3, the tabs 53 must be bent inwardly until the base will fit into drawer 12.

After the base 14 has been positioned, it is necessary to mark the currency compartment 28 where the currency clip structure 36 is to be mounted. Currency tray 24, in a preferred embodiment of the invention includes a plastic insert 26 which defines the numerous currency compartments 28. Alternatively, the tray 24 may have its own integral, vertical walls which define the currency compartments 28. Currency tray 24 has a series of openings 54 formed in its bottom wall 50 so that the bottom wall 50 does not interfere with the magnetic field created in the region of switch 16 by magnet 34 when the clip arm 32 is in the downward position. For best operation, the currency clip structure 36 should be positioned over one of the tray openings 54 across the center of currency tray 24. When the particular compartment 28 is chosen, the currency insert 26 is removed and the currency tray base 14 is marked through the base openings 54. That is, the tray base 14 is marked where the currency clip structure 36 will be positioned in tray 24.

The telephone block connector 20 is then mounted on the bottom side 17 of the currency tray base 14 using an adhesive such as double-sided tape. Block connector 20 should be mounted to the rear of base 14 so that telephone output line 22 may be connected between block connector 20 and jack 23.

Next, reed relay switch 16 is positioned on the underside 17 of tray base 14. Utilizing an adhesive such as double-sided tape, the switch 16 is positioned below the base location which was marked to correspond to the currency compartment in the tray which will contain the currency clip structure 36. As seen in FIG. 3, the base 14 includes a plurality of screw holes 56 which allow switch 16 to be positioned in various positions across the center of base 14. Corresponding screw holes 57 in switch 16 are aligned with the base screw holes 56 to position switch 16 closest to the previously marked position on base 14. The switch 16 is held to base 14 by two screws 58. The lead wires 18 from switch 16 are then connected to the block connector 20. As discussed above, switch 16 is preferably normally closed so that the switch 16, lines 18 and block connector 20 all present a continuous circuit.

After the base construction is completed, the currency clip structure 36 is attached to the chosen compartment 28. The clip structure 36 is centered against the rear compartment wall 31 and is positioned low on wall 31 against the bottom wall 35 of the compartment 28. This places the actuating magnet 34 closer to switch 16 in tray base 14 when the clip arm 32 falls into the downward position. Next, one cushion pad 40 is applied below the clip structure 36 where it will strike the compartment rear wall 31 when it falls, and another similar cushion pad 40 is applied and abutting against clip arm 32.

With switch 16 and block connector 20 connected to base 14 at their appropriate positions, and the clip structure 36 located in the proper currency compartment 28, the base 14 is installed in drawer 12 and secured as necessary. This step should be accomplished while making sure that the block connector 20 faces the rear of drawer 12 and that base 14 is positioned to orient tray 24 in the desired direction with clip structure 36 and switch 16 aligned in the correct currency compartment 28. The telephone output line 22 is then connected between telephone jack 23 and block connector 20 through the rear of base 14 and hole 47 drilled in the rear of drawer 12.

The currency clip structure 36 is tested by swinging the clip arm 32 into the upward position and placing a stack of bills below arm 32 or placing a few currency bills between arm 32 and currency standoff 41. Once this is done, the currency tray 24 and insert 26 are placed in drawer 12 on top of base 14. With the currency tray 24 placed on base 14 and the clip arm 32 and magnet 34 propped in the upward position, the switch 16 will be closed and no alarm will be initiated. However, upon removal of the bills, arm 32 should fall freely bringing the magnet in proximity to switch 16 to open the switch and the circuit, and initiate an alarm.

In the preferred embodiment of the invention disclosed herein, the cylindrical magnet 34 is polarity sensitive. Therefore, if switch 16 does not open when tested, the magnet may be slid out of arm 32, flipped 180° and reinserted into clip arm 32. Once the clip structure 36 has been tested and the money removal sensor system 5 of the present invention is working properly, the currency standoff 41 (See FIG. 4) may be permanently fastened within the appropriate compartment and the currency insert 26 fixed permanently to currency tray 24. When utilizing the system of the present invention, there should always be a stack of currency 29 or currency within a currency standoff 41 located within the armed compartment 28 to prevent false alarms. In an alternative embodiment, each compartment 28 within tray 24 might include a similar switch 16 and clip structure 36 such that money removed from any compartment 28 initiates an alarm.

While the present invention has been illustrated by the description of embodiments thereof, and while the embodiments have been described in considerable detail, it is not the intention of Applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of Applicants' general inventive concept.

What is claimed is:

1. A currency removal sensor system for detecting removal of cash from a cash drawer with a bottom surface comprising:

a magnetic field sensor positioned at a predetermined location in the drawer bottom surface, the sensor detecting the presence of a magnetic field and being coupled to alarm circuitry to initiate an alarm sequence upon detecting said magnetic field;

a removable currency tray positionable in the drawer on top of the drawer bottom surface and including at least one currency compartment with a bottom surface and a generally planar back wall of a defined height to hold currency, the tray and drawer being free from direct electrical connection together and the tray being positionable in the drawer such that the magnetic field sensor is located below said currency compartment and is proximate the back wall of the compartment;

an elongated clip device including a field-generating element positioned at an outward end of the clip device for generating a magnetic field outwardly from said outward end in the longitudinal direction of the clip device, the clip device mounted at an inward end to pivot from the back wall of the currency compartment at a point spaced above the bottom surface of the currency compartment;

the clip device being dimensioned in length less than the height of the back wall end operable to pivot to a downward position wherein the clip device lies against the back wall in a vertical plane generally parallel to the plane of the back wall for being generally unnoticeable in the currency compartment, when in the downward position, the clip device suspending said field-generating element vertically above the field sensor to generate a magnetic field downwardly and in a direction generally vertically co-planar with the field sensor, the downwardly directed magnetic field having an effective strength to be detectable by said field sensor when the tray is installed in the drawer;

the clip device further being operable to pivot to an upward position wherein the elongated clip extends in a plane angled from the plane of the back wall and maintains the field-generating element away from the back wall such that the field generating element generates a field outwardly from the back wall and away from the field sensor so as not to be detected by said field sensor when the tray is installed in the drawer;

whereby when the clip device is held in its upward position by a stack of currency, the removable currency tray with said stack of currency therein may be quickly and easily removed from and returned to the cash drawer without initiating an alarm sequence, however, removing currency from under the clip when the tray is in the drawer causes the clip device to move to the downward position generally noticed within the currency compartment to initiate an alarm sequence without visually indicating the presence of an alarm.

2. The currency removal sensor of claim 1 further comprising a tray base configured to fit into the bottom of the cash drawer, the field sensor positioned at a predetermined location on the base and the removable tray sitting on top of said tray base such that the said field-generating element is generally vertically co-planar with the field sensor when said clip is in its downward position, the base and tray being free from direct electrical connection together whereby the currency tray may be quickly and easily removed from and returned to the tray base.

3. The currency removal sensor system of claim 1, wherein the clip device includes a permanent magnet which generates a magnetic field vertically downwardly toward field sensor when the clip device is in the downward position and the tray is installed in the drawer.

4. The currency removal sensor system of claim 1, wherein the field sensor includes a magnetically-activated switch.

5. The currency removal sensor system of claim 4, wherein the magnetically-activated switch is normally closed and opens upon detection of a magnetic field to initiate an alarm, the normally closed magnetically-activated switch establishing electrical continuity in the system whereby a break in continuity in the system initiates an alarm.

6. The currency removal sensor system of claim 1, wherein the tray has a plurality of currency compartments, the clip device being selectively movable to pivot from the back wall of a specific compartment within the tray.

7. The currency removal sensor system of claim 1, wherein the field sensor is selectively movable to different locations in the drawer bottom surface to vary the location of the currency compartment which initiates the alarm.

8. The currency removal sensor system of claim 1 further comprising an adaptor to removably couple the field sensor to the alarm circuitry with a telephone line.

9. The currency removal sensor system of claim 1 further comprising at least one cushion placed on the back wall of the currency compartment below the clip device to cushion the clip device and prevent the clip device from noisily striking the back wall when it moves between the upward and downward positions in the tray to prevent an audible indication that an alarm is initiated.

10. The currency removal sensor system of claim 1 further comprising a currency standoff situated in the currency compartment, the standoff supporting the currency stack above the bottom drawer surface to support the clip device in the upward position with a thin currency stack.

11. The currency removal sensor system of claim 1 wherein the tray includes an opening formed below the currency compartment bottom wall proximate the field sensor to achieve more efficient coupling of the magnetic field from the field-generating element to the magnetic field sensor.

* * * * *

UNITED STATES PATENT AND TRADEMARK OFFICE

CERTIFICATE OF CORRECTION

PATENT NO. : 5,512,877

DATED : April 30, 1996

INVENTOR(S) : Gels et al.

It is certified that error appears in the above-identified patent and that said Letters Patent are hereby corrected as shown below:

On the title page:

Page 1, item [22], please delete the number "1905" and insert the correct filing year of --1995--.

Column 10, line 8, please delete the word "end" and insert the word --and--.

Column 10, line 34, please delete the word "noticed" and insert the word --unnoticed--.

Signed and Sealed this

Twenty-fourth Day of September, 1996

*Attest:*

*Attesting Officer*

BRUCE LEHMAN

*Commissioner of Patents and Trademarks*